US009722378B2

(12) United States Patent
Hsu

(10) Patent No.: US 9,722,378 B2
(45) Date of Patent: Aug. 1, 2017

(54) CONDUCTIVE DEVICE AND ELECTRICAL SOCKET FOR PROVIDING ELECTRIC POWER

(71) Applicant: POWERTECH INDUSTRIAL CO., LTD., New Taipei (TW)

(72) Inventor: Jung-Hui Hsu, New Taipei (TW)

(73) Assignee: POWERTECH INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 15/056,126

(22) Filed: Feb. 29, 2016

(65) Prior Publication Data

US 2016/0344150 A1 Nov. 24, 2016

(30) Foreign Application Priority Data

May 20, 2015 (TW) ..... 104116083 A

(51) Int. Cl.
*H01R 25/00* (2006.01)
*H01R 31/06* (2006.01)

(52) U.S. Cl.
CPC ..... *H01R 31/065* (2013.01)

(58) Field of Classification Search
CPC ..... H01R 24/54; H01R 25/00; H01R 31/06; H01R 33/88; H01R 33/94
USPC ..... 439/638, 928, 637, 650, 717
See application file for complete search history.

(56) References Cited

U.S. PATENT DOCUMENTS 4,532,579 A * 7/1985 Merryman ..... F21V 21/005 362/239
5,117,122 A * 5/1992 Hogarth ..... H01R 27/02 174/53
8,283,802 B2 * 10/2012 Jansma ..... H01R 13/6272 307/23
8,471,718 B1 * 6/2013 Miller ..... G04C 23/04 307/131
2008/0012423 A1 * 1/2008 Mimran ..... H01R 25/003 307/11

* cited by examiner

*Primary Examiner* — Phuong Dinh
(74) *Attorney, Agent, or Firm* — Li & Cai Intellectual Property (USA) Office

(57) ABSTRACT

A conductive device and a socket for providing electric power are provided. The conductive device includes a block body, at least two terminal structures, and an equipotential layer. The block body has a fixing portion having at least two holes formed thereon. The two terminal structures are arranged inside of the block body and respectively near to the holes. The equipotential layer is electrically connected to the two terminal structures and set to have the same polarity as that of the two terminal structures.

7 Claims, 17 Drawing Sheets

CONDUCTIVE DEVICE AND ELECTRICAL SOCKET FOR PROVIDING ELECTRIC POWER

BACKGROUND OF THE INVENTION

1. Field of the Invention

The present invention relates to a conductive device capable of assembling each with another and an electrical socket capable of assembling with the conductive device.

2. Description of Related Art

The power of electrical devices is usually supplied by the battery which can be repeatedly charged and discharged.

In the prior art technology, the conductive adapter building blocks have been developed. Specifically, the electrical connections can be established among the conductive adapter building blocks in different shapes by assembling the blocks with each other.

However, the prior art conductive adapter building blocks cannot be used to supply power to portable electronic devices. Actually, if the conductive adapter building blocks are assembled to supply power, the voltage may rise too high due to the series connection of these conductive adapter building blocks, and the portable electronic device is likely to break down.

SUMMARY OF THE INVENTION

The object of the present invention is to provide a conductive device and electrical socket for providing electric power, which can be assembled to each other to form different chargers having different size and different functional interfaces.

In order to achieve the aforementioned objects, according to an embodiment of the present invention, a conductive device includes a block body, at least two terminal structures and an equipotential layer. The block body has a fixing portion, in which the fixing portion has at least two holes formed thereon. Two terminal structures are arranged inside the block body and immediately adjacent to the holes, respectively. The equipotential layer is electrically connected to the two terminal structures and set to have the same polarity as that of the two terminal structures.

According to another embodiment of the instant disclosure, an electrical socket is provided. The electrical socket includes a block body, a power converting module, and a conductive assembly. The block body has a block assembly portion and at least one power supply interface. The power converting module is used for receiving an external power through the power supply interface and converting the external power to a direct current power. The conductive assembly is electrically connected to the power converting module and includes a plurality of first terminal structures exposed on the block assembly portion so as to output the direct current power through the first terminal structures.

According to another embodiment of the instant disclosure, another electrical socket is provided. The electrical socket includes a block body and a conductive assembly. The block body has a block assembly portion and at least one power supply interface for receiving a direct current power. The conductive assembly is electrically connected to the power supply interface and includes a plurality of first terminal structures exposed on the block assembly portion.

All of the terminal structures of the conductive device electrically connected to the equipotential layer have the same electric potential. When the conductive devices are assembled to each other for charging the portable electronic device, the terminal structures of different conductive devices are not connected in series. As such, the voltage for charging the portable electronic device may not rise and result in damage of the portable electronic device. Additionally, the user can assemble the conductive devices having different shapes and functional interfaces to each other, which are selected according to practical demands, to form different chargers having different size and functional interfaces.

In order to further the understanding regarding the present invention, the following embodiments are provided along with illustrations to facilitate the disclosure of the present invention.

DETAILED DESCRIPTION OF THE PREFERRED EMBODIMENTS

The aforementioned illustrations and following detailed descriptions are exemplary for the purpose of further explaining the scope of the present invention. Other objectives and advantages related to the present invention will be illustrated in the subsequent descriptions and appended drawings.

Figure 1A:
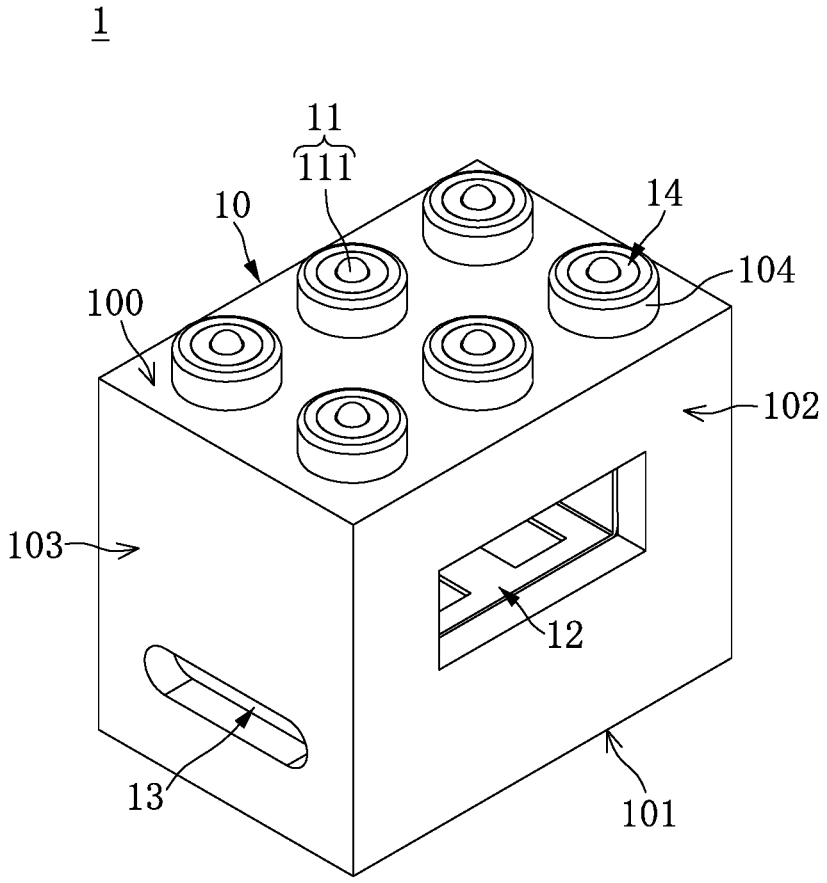
FIG. 1A shows a perspective view of a conductive device according to an embodiment of the present invention.
Figure 1B:
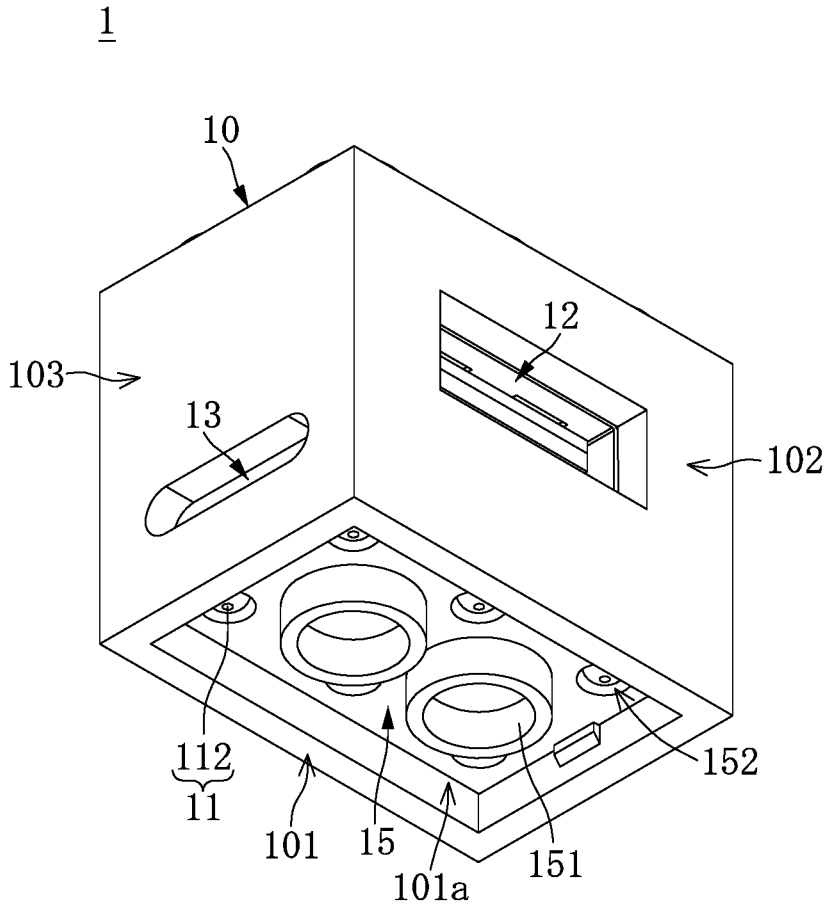
FIG. 1B shows a perspective view of a conductive device shown in FIG. 1A viewed from another aspect according to an embodiment of the present invention.

Please refer to FIG. 1A and FIG. 1B. FIG. 1A shows a perspective view of a conductive device according to an embodiment of the present invention, and FIG. 1B shows a perspective view of a conductive device shown in FIG. 1A viewed from another aspect according to an embodiment of the present invention.

The conductive device 1 includes a block body 10, a conductive assembly 11, and an electrical interface, in which the electrical interface is an output interface 12 for outputting power.

The block body 10 is standard in size, such as a building block. The block body 10 has a first fixing portion 100 and a second fixing portion 101, which are arranged at two opposite sides of the block body 10. Please refer to FIG. 1A. The first fixing portion 100 of the block body 10 has a plurality of hollow interlocking posts 104 so that the first fixing portion 100 has a plurality of holes formed therein.

Please refer to FIG. 1B. The second fixing portion 101 of the block body 10 has a surface depressed inward to form an engaging hole 101*a*, and at least one engaging portion 151 is disposed on the inside surface of the engaging hole 101*a*. In this embodiment, two engaging portions are shown in FIG. 1B. However, in another embodiment, no engaging portion is disposed on the inside surface of the engaging hole.

When two conductive devices 1 are assembled with each other, the interlocking posts 104 of one of the conductive devices 1 inserts into the engaging hole 101*a* of the other conductive device 1, the engaging portion 151 is held among four interlocking posts 104, and the interlocking posts 104 are held between a sidewall of the engaging hole 101*a* and a sidewall of the engaging portion 151. As such, the two conductive devices 1 are assembled and fixed to each other.

Figure 2A:
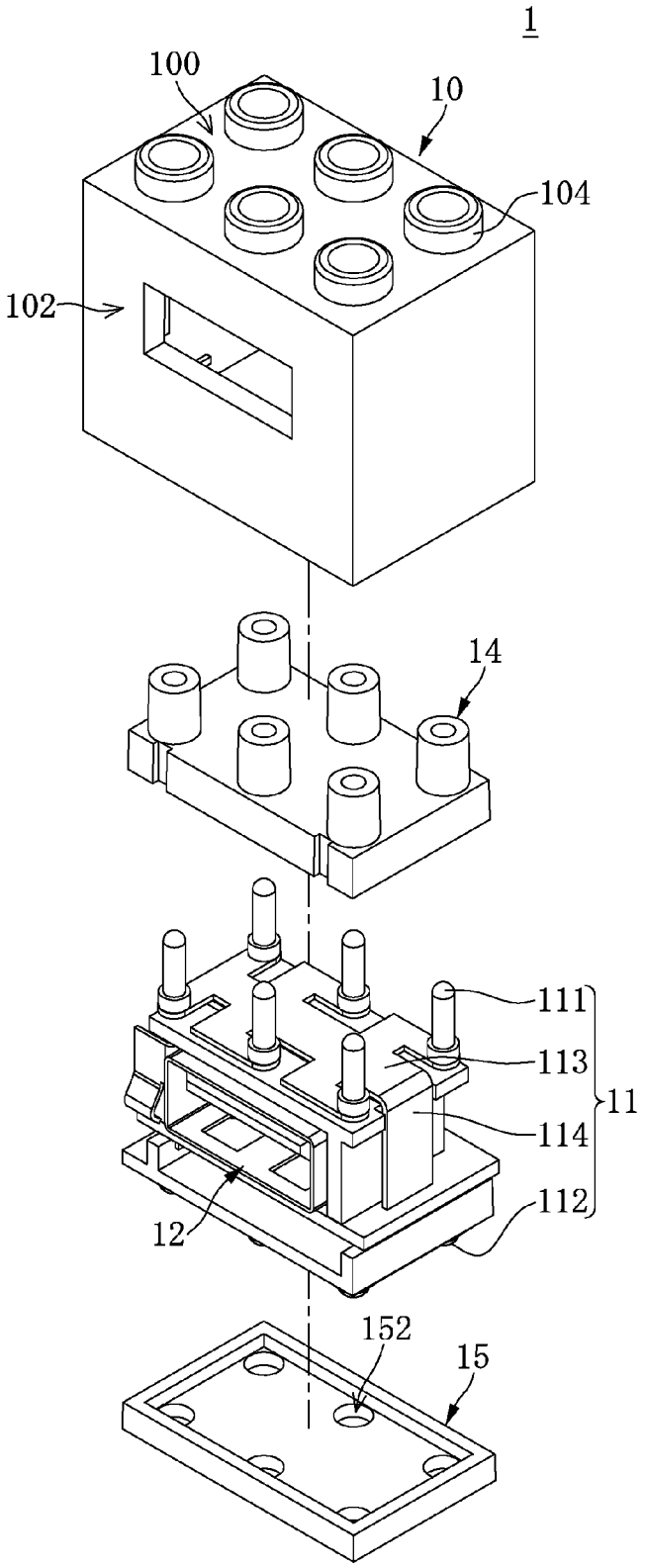
FIG. 2A shows an exploded view of a conductive device according to an embodiment of the present invention.
Figure 2B:
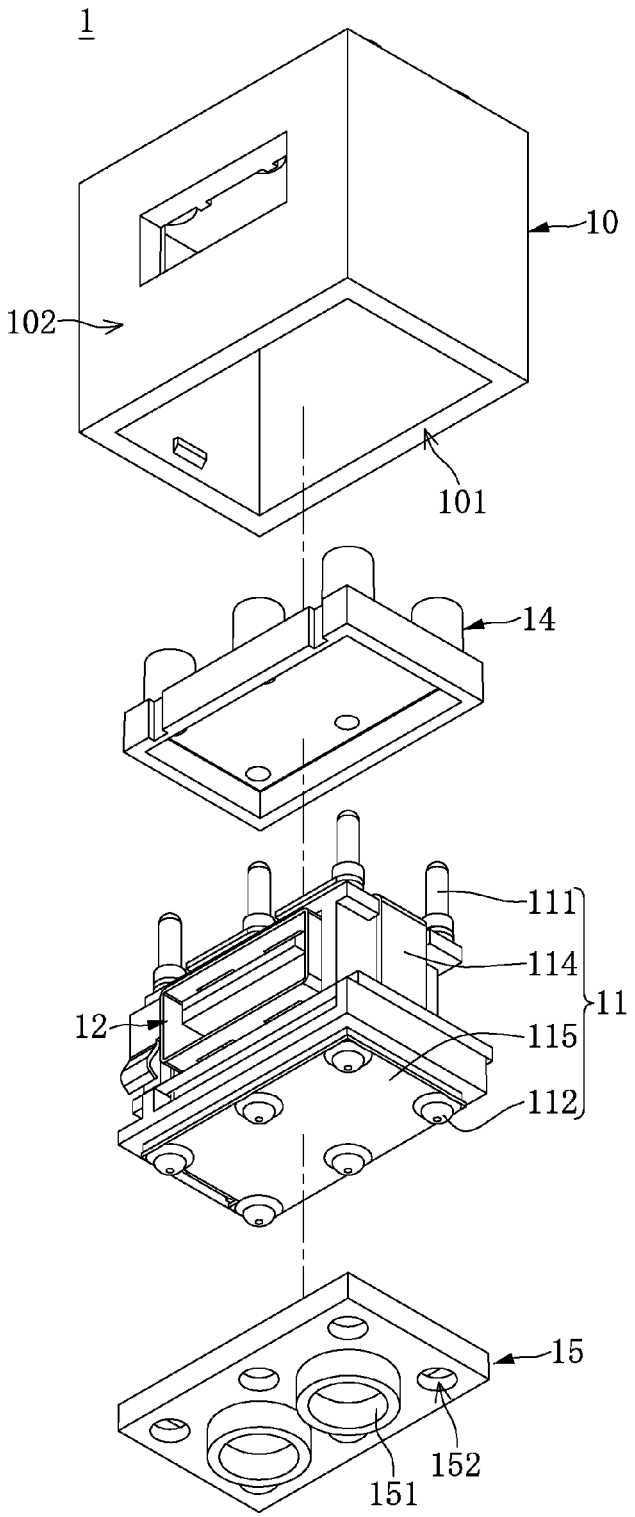
FIG. 2B shows another exploded view of the conductive device shown in FIG. 2A viewed from another aspect according to an embodiment of the present invention.

Please refer to FIG. 2A and FIG. 2B. FIG. 2A shows an exploded view of a conductive device according to an embodiment of the present invention, and FIG. 2B shows another exploded view of the conductive device shown in FIG. 2A viewed from another aspect according to an embodiment of the present invention.

As shown in FIG. 2A, the conductive assembly 11 is disposed inside the block body 10 and includes a plurality of first terminal structures 111 and a plurality of second terminal structures 112. The first terminal structures 111 pass through the interlocking posts 104, respectively, and are exposed outside the block body 10 respectively through the holes of the first fixing portion 100.

The block body 10 can further include a plurality of tube bodies 14 disposed on a plate (not labeled). The tube bodies 14 are respectively inserted into the interlocking posts 104, and the first terminal structures 111 respectively pass through the tube bodies 14 and extend outside of the block body 10. As shown in FIG. 1A, a top end of each first terminal structure 111 is higher than a top surface of the corresponding tube body 14 and a top surface of the corresponding interlocking post 104. In addition, as long as each first terminal structure 111 is insulated from the corresponding interlocking post 104, the tube body 14 can be omitted.

Please refer to FIG. 2B. The second terminal structures 112 are electrically connected to the first terminal structures 111. The conductive assembly 11 further includes a first equipotential layer 1113, a bending portion 114, and a second equipotential layer 115 so that the first terminal structures 111 can be electrically connected to the second terminal structures 112.

The first terminal structures 111 are disposed on the first equipotential layer 113 to form a plurality of output circuit paths, and the second terminal structures 112 are disposed on the second equipotential layer 115 to form a plurality of input circuit paths. The first terminal structures 111 are electrically connected to each other in parallel through the first equipotential layer 113. The second terminal structures 112 are electrically connected to each other in parallel through the second equipotential layer 115. Furthermore, the first and second equipotential layers 113, 115 are electrically connected to each other through the traces configured on a printed circuit board (not labeled).

In one embodiment, a plurality of the first terminal structures 111 and the first equipotential layer 113 are set to have the same polarity, i.e., the same voltage to serve as a positive electrode or negative electrode of a DC output circuit. Additionally, the second terminal structures 112 and the second equipotential layer 115 are electrically connected to the first equipotential layer 113 to have the same polarity as the first equipotential layer 113.

That is to say, when the first terminal structures 111 and the first equipotential layer 113 commonly serve as a positive electrode of the DC output circuit, the second terminal structure 112 and the second equipotential layer 115 also serve as the positive electrode of the DC output circuit. In the instant embodiment, two equipotential layers, i.e., the equipotential layers 113 and 115, are shown in FIGS. 2A and 2B. However, in another embodiment, only one equipotential layer is used to be electrically connected between the first and second terminal structures 111, 112, so that the first and second terminal structures 111, 112 have the same potential.

As shown in FIG. 2B, the second terminal structures 112 of the instant embodiment are the protruding portions protruding from a surface of the second equipotential layer 115. In the embodiment, the block body 10 further includes a bottom cover 15 having a plurality of openings 152 formed thereon. The second terminal structures 112 are exposed on a surface of the bottom cover 115 respectively through the openings 152. Additionally, the engaging portions 151 are also disposed on the bottom cover 15.

When two conductive devices 1 are assembled with each other, at least one first terminal structure 111 located in the corresponding interlocking post 104 inserts into the corresponding opening 152 so that the first terminal structure 111 contacts the second terminal structure 112 located in the opening 152. As such, after two conductive devices 1 are assembled with each other, an electrical connection can be established between two conductive devices 1.

As long as one of the first terminal structures 111 is in contact with one of the second terminal structures 112 located in the opening 152, the electrical connection between two conductive devices 1 can be established. It is to be understood that not necessarily all of the first terminal structures 111 insert into the corresponding openings 152. As such, the shape of the charger can be varied.

In addition, when the conductive devices are assembled, the circuit can flow from the second terminal structures 112 to each of the first terminal structures 111 through the second equipotential layer 115 and the first equipotential layer 113, thereafter, the circuit flows into another conductive device 1. As such, the voltage may not rise due to the assembly of the conductive devices 1.

The conductive device 1 can include a conductive portion disposed on the block body 10, and there is a potential difference between the conductive portion and the conductive assembly 11 (the first terminal structures 111, the first equipotential layer 113, the second terminal structure 112 or the second equipotential 115) to form a DC transmission circuit. When the conductive portion has an electrical potential lower than that of conductive assembly 11, the conductive assembly 11 can serve as the positive terminal, and the conductive portion can serve as the negative terminal. On the contrary, when the conductive portion has an electrical potential higher than that of the conductive assembly 11, the conductive assembly 11 can serve as the negative terminal, and the conductive portion can serve as positive terminal.

As mentioned previously, the conductive portion can serve as a positive terminal or a ground terminal. When two or more conductive devices 1 are assembled with each other, as long as the conductive devices 1 can be electrically connected to each other by the connections between the conductive portions, each of which is disposed on an outer surface of each block body 10, the position or shape of the conductive portion is not limited herein.

Please refer to FIG. 1A. The block body 10 has a first side surface 102 and a second side surface 103 positioned between the first fixing portion 100 and the second portion 101. The output interface 12 is positioned at the first side surface 102 and electrically connected to the conductive assembly 11. In addition, the output interface 12 is electrically connected to the DC output circuit formed by the conductive portion and the conductive assembly 11 in parallel.

The output interface 12 can be a DC power output interface or an AC power output interface, such as a USB interface. The conductive device 1 can be electrically connected to an external electronic device through the output interface 12.

The output interface 12 is open toward a direction which is inclined at an angle ranging from 0 degree to 180 degrees relative to an extending direction of the first terminal structure 111. That is, the output interface 12 is open toward a direction that is not parallel to the extending direction of the first terminal structure 111.

The conductive device 1 further includes an input interface 13 electrically connected to the conductive assembly 11, and the input interface 13 is electrically connected to the DC output circuit formed by the conductive portion and the conductive assembly 11 in parallel.

Figure 3A:
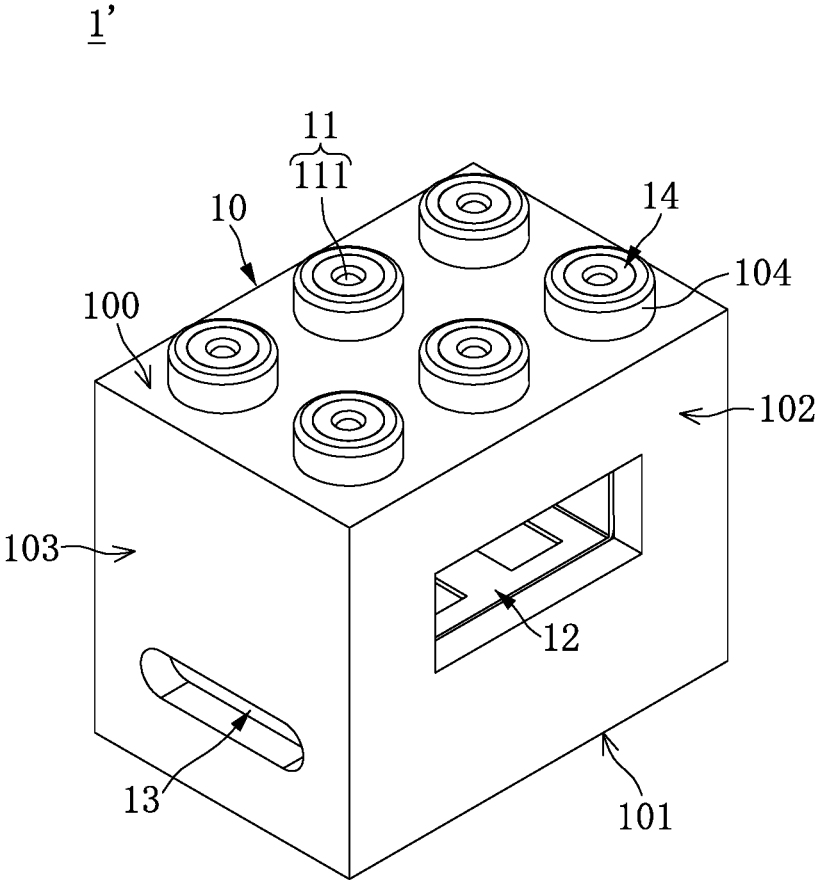
FIG. 3A shows a perspective view of a conductive device according to another embodiment of the present invention.
Figure 3B:
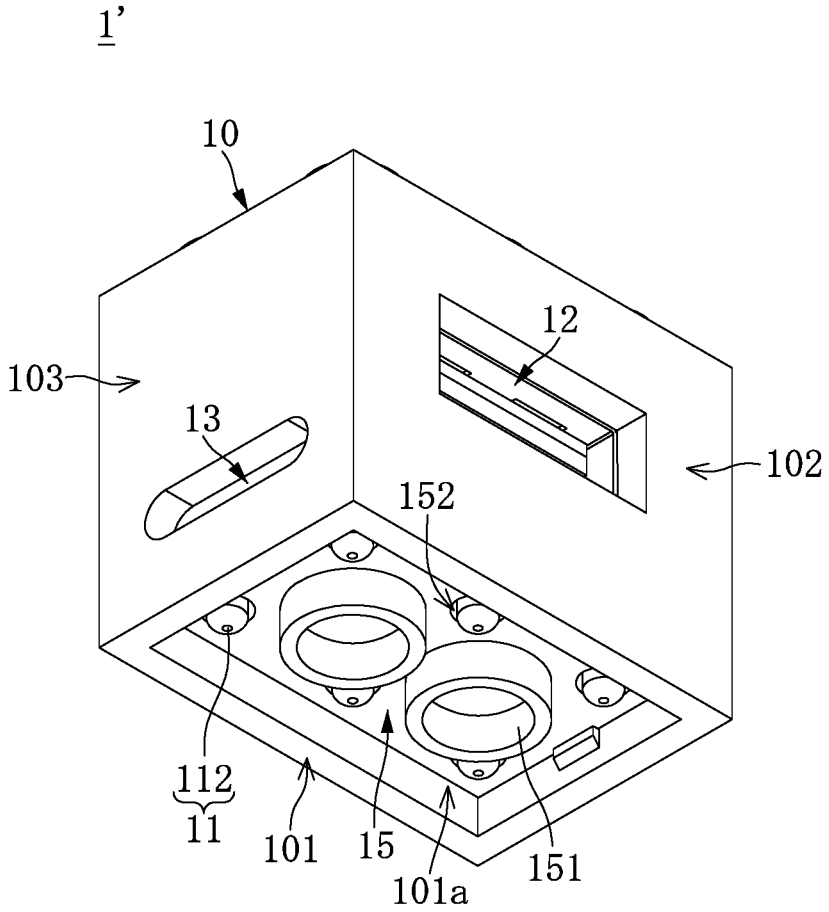
FIG. 3B shows a perspective view of a conductive device shown in FIG. 3A viewed from another aspect according to an embodiment of the present invention.

Please refer to FIG. 3A and FIG. 3B. FIG. 3A shows a perspective view of a conductive device according to another embodiment of the present invention. FIG. 3B shows a perspective view of a conductive device shown in FIG. 3A viewed from another aspect according to an embodiment of the present invention. The same reference numerals are given to the same components or to components corresponding to those in the previous embodiment, and descriptions of the common portions are omitted.

As shown in FIG. 3A, a difference between this embodiment and the previous embodiment is the top end of each first terminal structure 111 is lower than the top surface of the corresponding interlocking post 104. Moreover, the second terminal structures 112 are exposed through the opening 152 and extend out of the bottom cover 15, as shown in FIG. 3B.

As such, a probability of short-circuit occurrence due to the situation that the first terminal structure 111 and the conductive portion formed on the outer surface of the block body 10 being simultaneously in contact with an external conductor, such as paper clip, can be decreased.

The disclosure does not limit that the first and second terminal structures 111, 112 extend out of the block body 10. The top end of each first terminal structure or the second terminal structure can extend out of the block body, be lower than or equal to the block body.

Figure 4A:
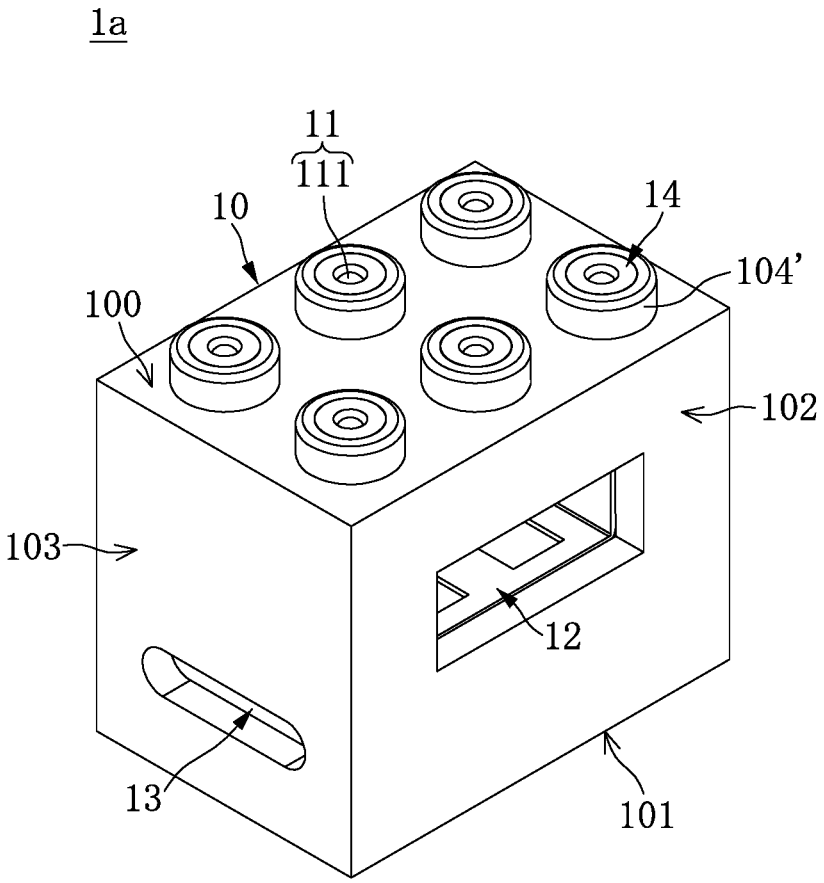
FIG. 4A shows a perspective view of a conductive device according to another embodiment of the present invention.
Figure 4B:
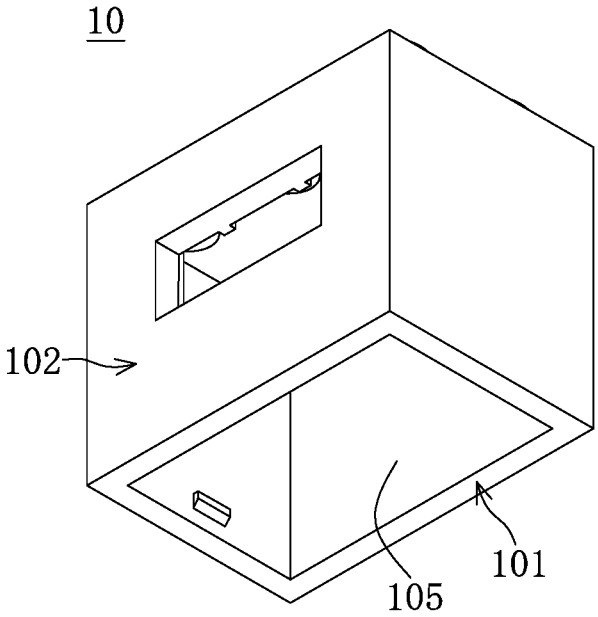
FIG. 4B shows a perspective view of a conductive device shown in FIG. 4A viewed from another aspect according to an embodiment of the present invention.

In the embodiment shown in FIG. 3A and FIG. 3B, the block body 10 can be made of insulating material, and the conductive portion can be a conductive layer formed on an outer surface of each interlocking post 104, and the conductive layer is electrically connected to an inner wall surface of the engaging hole 101*a* or to an outer wall surface of the engaging portion 151. In addition, the conductive layer has a potential difference with the conductive assembly 11. Please refer to FIG. 4A and FIG. 4B. FIG. 4A shows a perspective view of a conductive device according to another embodiment of the present invention, and FIG. 4B shows a perspective view of a conductive device shown in FIG. 4A viewed from another aspect according to an embodiment of the present invention.

In the embodiment shown in FIG. 4A, the block body 10 and the interlocking posts 104' of the conductive device 1*a* are made of insulating material, but there is a conductive layer formed on the outer surface of each interlocking post 104'.

The block body 10 has a conductive layer formed on an inner surface 105 to form another terminal structure, and the conductive layer is set to have another polarity reverse to that of the first terminal structure 111. The conductive layer formed on the inner surface 105 can be electrically connected to the conductive layer formed on the outer surface of the interlocking post 104'. That is, in this embodiment, the conductive portion includes the conductive layers formed on the outer surface of each interlocking post 104' and formed on the inner surface of the block body 10. Accordingly, one of the terminal structures having one of the polarities is surrounded by another terminal structure having the reverse polarity.

Figure 5:
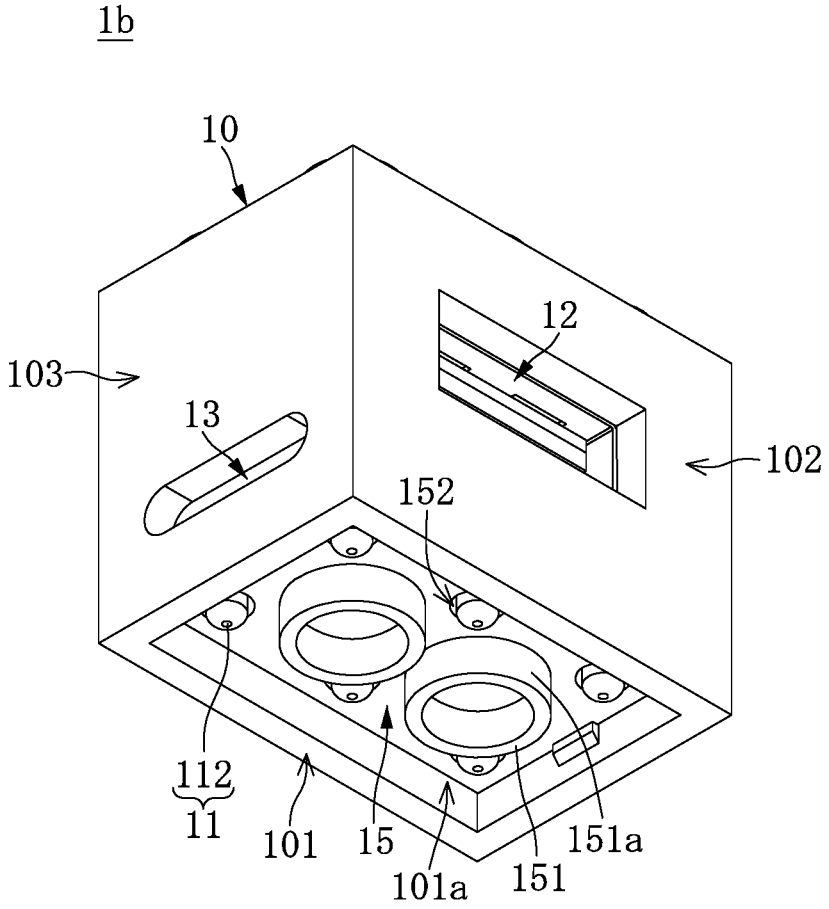
FIG. 5 shows a perspective view of a conductive device according to another embodiment of the present invention.

In addition, please refer to FIG. 5, which shows a perspective view of a conductive device according to another embodiment of the present invention. The block body 10 of the instant embodiment has similar shape to that shown in FIG. 4A. The conductive portion includes the conductive layers formed on the outer surface of each interlocking post 104' and on an outer sidewall surface 151*a* of the engaging portion 151. The conductive layer formed on the outer sidewall surface 151*a* is electrically connected to the conductive layer formed on the outer surface of each interlocking post 104'.

When two conductive device 1*b* are assembled to each other, not only are the conductive assemblies 11 of two conductive devices 1*b* in contact with each other, but also the conductive layer formed on the outer surface of each interlocking post 104' of one of the conductive device 1*b* is in contact with the conductive layer formed on the outer sidewall surface 151*a* of the engaging portion 151 of the other conductive device 1*b* by engaging the interlocking post 104' with the engaging portion 151. As such, the DC transmission circuit can be formed.

Figure 6:
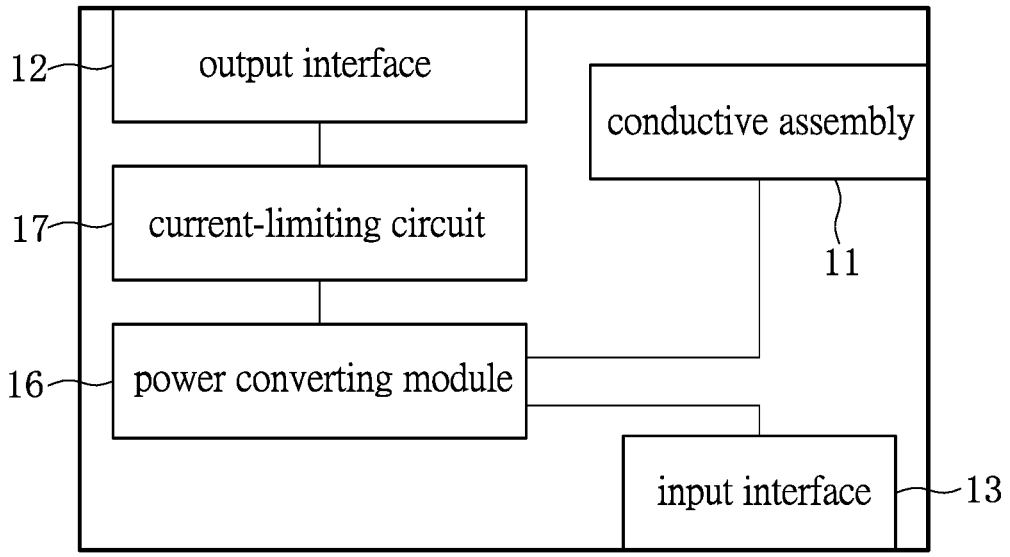
FIG. 6 shows a functional block diagram of a conductive device according to another embodiment of the present invention.

Please refer to FIG. 6. FIG. 6 shows a functional block diagram of a conductive device according to another embodiment of the present invention. In the instant embodiment, the conductive device can further include a current-limiting circuit 17 and a power converting module 16. The power converting module 16 is arranged in the block body 10 and electrically connected to the conductive assembly 11. When the conductive device 1 receives an alternating current from the input interface 13, the power converting module 16 can convert the alternating current to a direct current and transmit to the conductive assembly 11.

Figure 7:
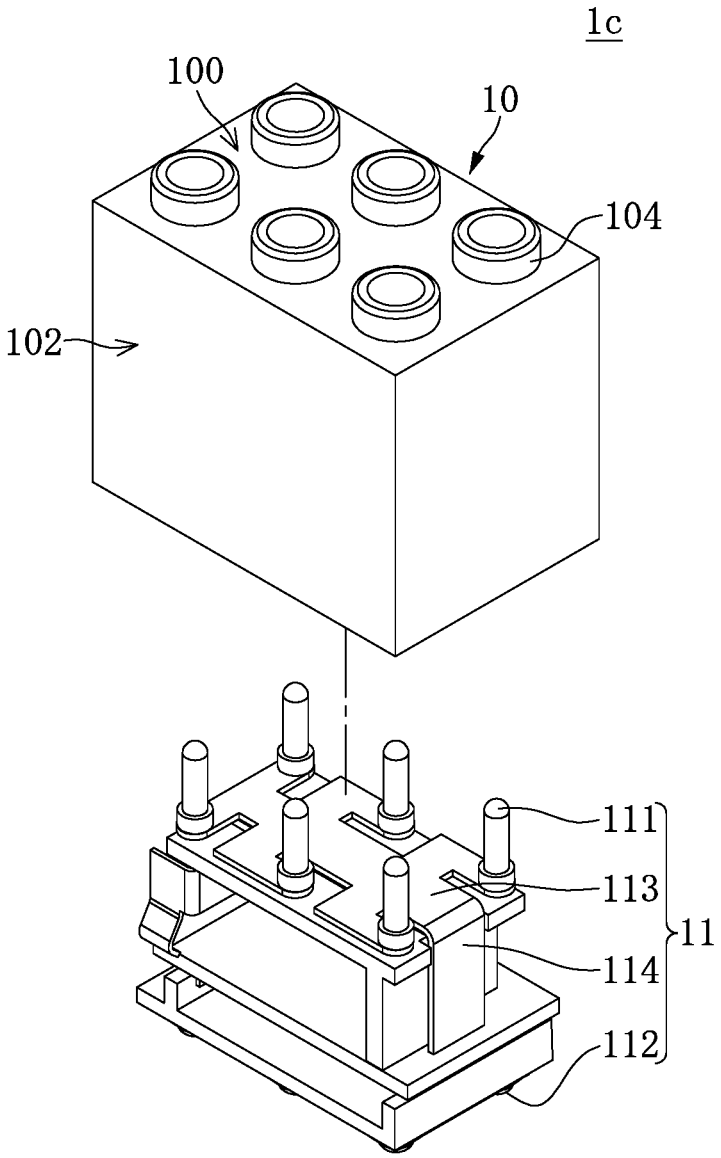
FIG. 7 shows an exploded view of a conductive device according to another embodiment of the present invention.

The current-limiting circuit 17 is electrically connected between the power converting module 16 and the output interface 12 to limit the current outputted from the output interface 12. Please refer to FIG. 7, which shows an exploded view of a conductive device according to another embodiment of the present invention. In the embodiment shown in FIG. 7, the electrical interface, i.e., the output interface 12 and the input interface 13, the tube body 14, and the bottom cover 15 are omitted in the conductive device 1*c*.

The structures of the first terminal structures 111, the first equipotential layer 113, the second terminal structures 112, and the bending portion 114 can be varied according to practical demands, and are not limited to the examples shown in the figures. The second terminal structures 112 and the first terminal structures 111 can be electrically connected to the same equipotential layer to minimize the size of the block body 10.

Figure 8:
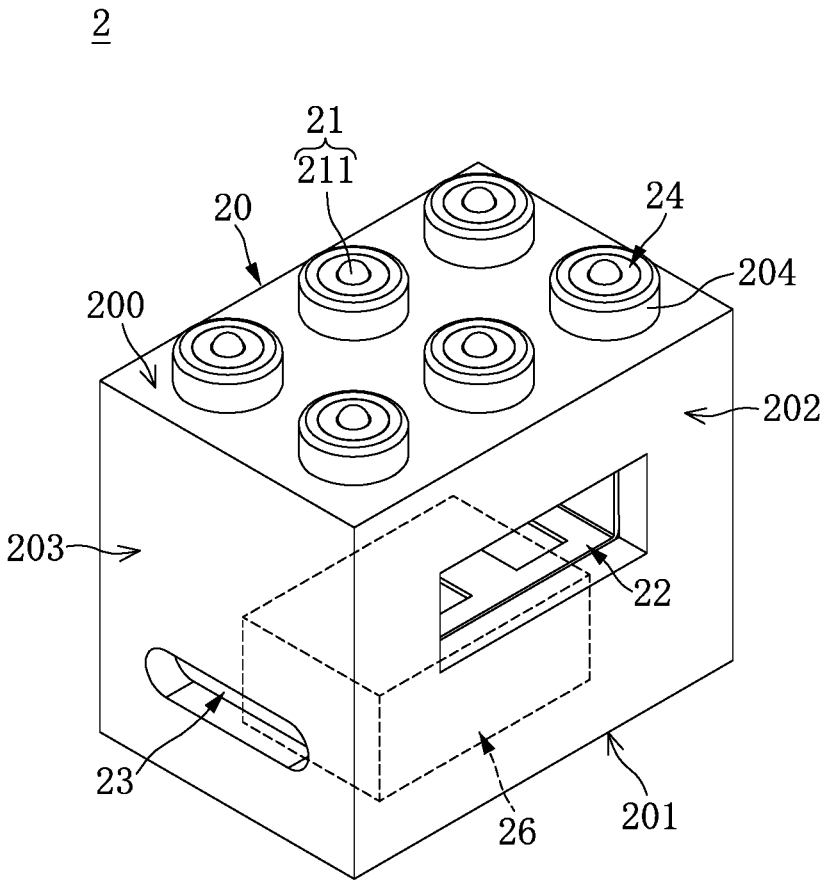
FIG. 8 shows a perspective view of a conductive device according to another embodiment of the present invention.

Please refer to FIG. 8, which shows a perspective view of a conductive device according to another embodiment of the present invention. In the instant embodiment, the conductive device 2 includes the block body 20, the conductive assembly 21, the electrical interface, and a rechargeable battery 26.

Figure 9:
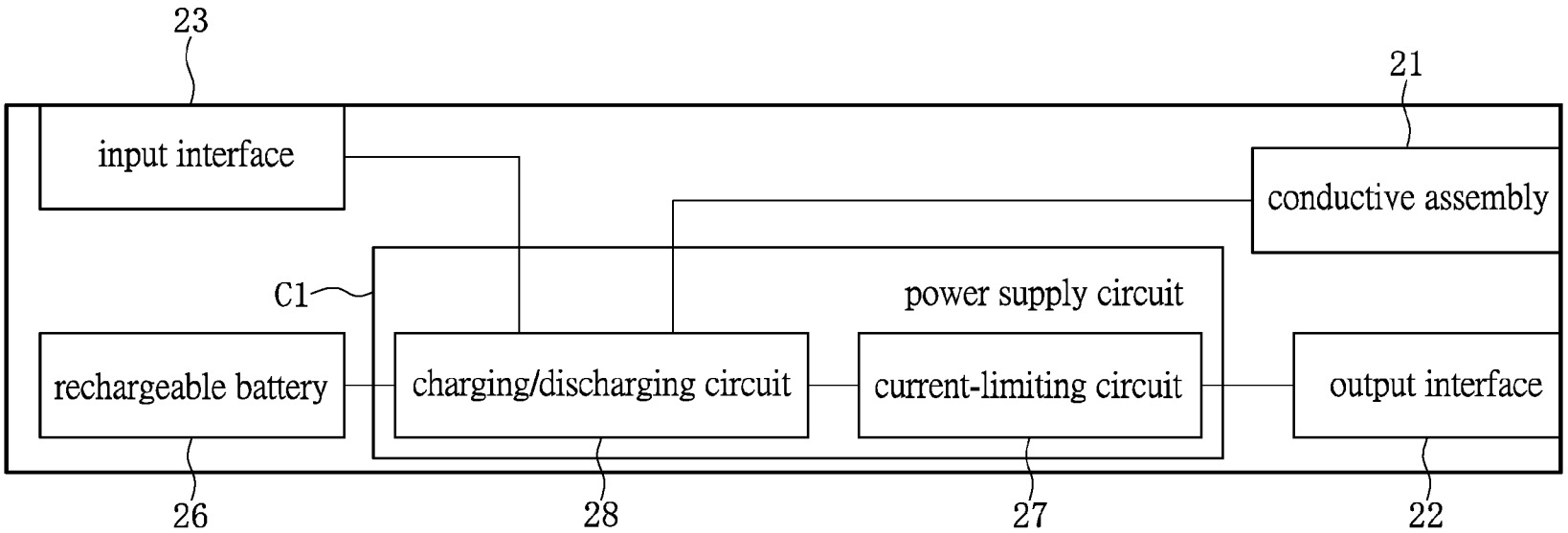
FIG. 9 shows a functional block diagram of a conductive device according to another embodiment of the present invention.

The rechargeable battery 26 is positioned within the block body 20 to supply power to the output interface 22. When the rechargeable battery 26 has to be charged, an external power supply can charge the rechargeable battery 26 through the input interface 23. Please refer to FIG. 9. FIG. 9 shows a functional block diagram of a conductive device according to another embodiment of the present invention. The conductive device can include a power supply circuit C1, and all of the output interface 22, the input interface 23 and the conductive assembly 21 are electrically connected to the rechargeable battery 26 through the power supply circuit C1.

The power supply circuit C1 can have various functions according to demands. In the instant embodiment, the power supply circuit C1 includes a charging/discharging circuit 28 and current-limiting circuit 27. The charging/discharging circuit 28 is electrically coupled to the rechargeable battery 26 to control the rechargeable battery 26 to supply power to the output interface 22 or to be charged by an external power supply through the input interface 23.

In the instant embodiment, the current-limiting circuit 27 is electrically connected between the charging/discharging circuit 28 and the output interface 22 to restrict an output current of the output interface 22.

Figure 10:
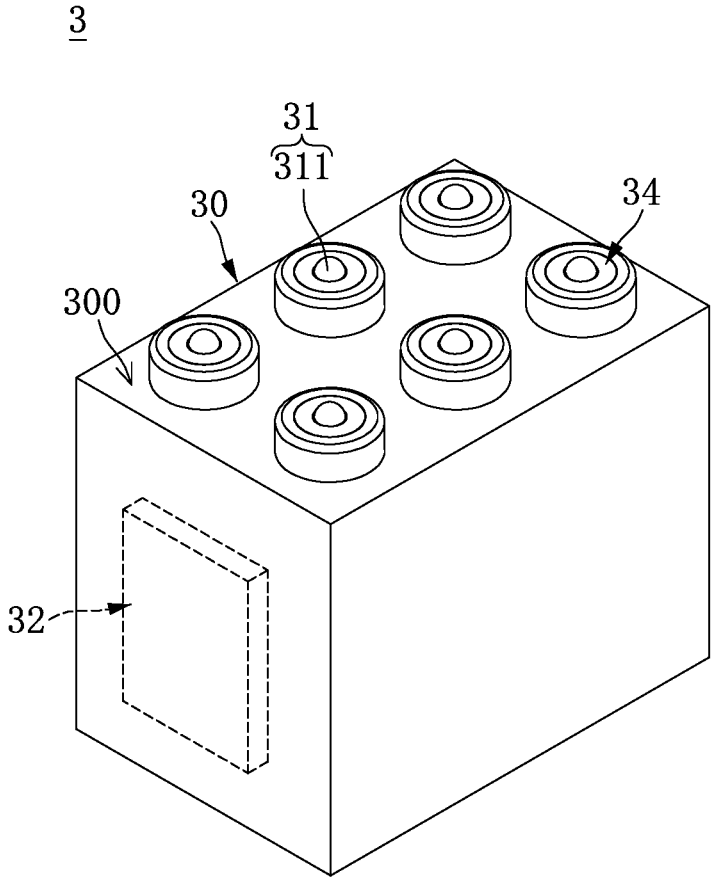
FIG. 10 shows a perspective view of a conductive device according to another embodiment of the present invention.

Please refer to FIG. 10, which shows a perspective view of a conductive device according to another embodiment of the present invention. In the instant embodiment, the conductive device 3 includes the block body 30, the conductive assembly 31 and the electrical interface, in which the electrical interface is a wireless charging module 32.

The conductive device 3 of the present embodiment includes the wireless charging module 32 arranged inside the block body 30 for charging the portable electronic devices.

Figure 11:
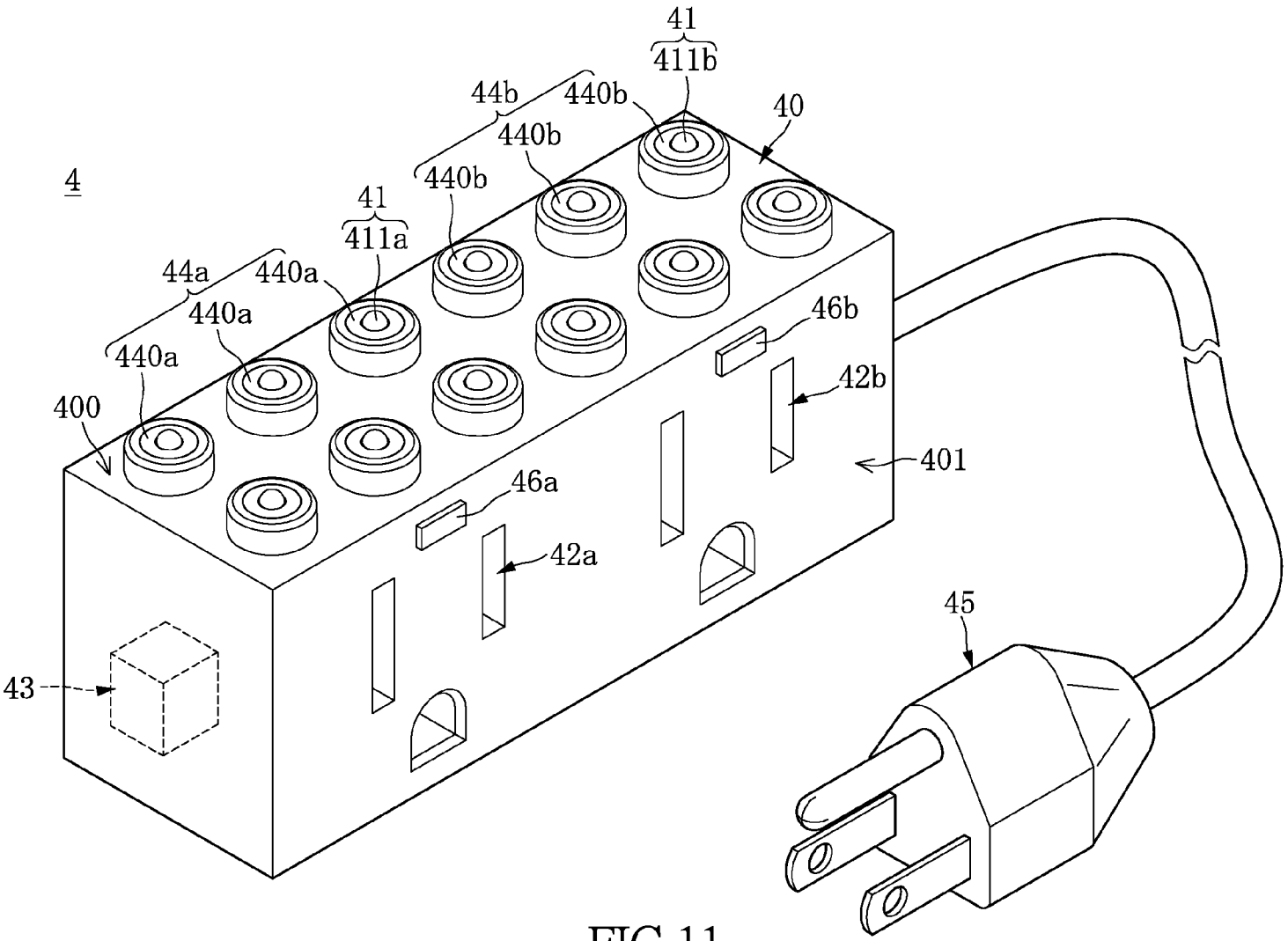
FIG. 11 shows a perspective view of an electrical socket according to another embodiment of the present invention.

Please refer to FIG. 11. FIG. 11 shows a perspective view of an electrical socket according to another embodiment of the present invention. The electrical socket 4 includes the block body 40, the conductive assembly 41, slot sets 42, power converting module 43, and power supply interface 45.

In the instant embodiment, the block body 40 has a size larger than that of the block body 10 of the conductive device 1. The block body 40 has a block assembly portion 400. The block assembly portion 400 is positioned at one side of the block body 40, and at least one slot set 42*a* or 42*b* is positioned at another side 401 of the block body 40. The block assembly portion 400 includes a first connecting portion 44*a*, and a second connecting portion 44*b*. The first jointing portion 44*a* includes a plurality of first interlocking posts 440*a* protruding from an outer surface of the block body 40, and the second connecting portion 44*b* includes a plurality of second interlocking posts 440*b*. The first and second interlocking posts 440*a*, 440*b* can be used to assemble with different conductive devices, respectively. Additionally, the first and second interlocking posts 440*a*, 440*b* are hollow posts, and the shape and size of each of the first and second interlocking posts 440*a*, 440*b* can match with the engaging hole 101*a* and engaging portion 151 of the conductive device 1. The conductive assembly 41 is arranged inside the block body 40 and electrically connected to the power supply interface 45. The conductive assembly 41 includes a plurality of first terminal structures 411*a* and second terminal structures 411*b*. The first terminal structures 411*a* are exposed outside the block body 40 respectively through the corresponding first interlocking post 440*a*, and the second terminal structures 411*b* are exposed outside the block body 40 respectively through the corresponding second interlocking post 440*b*.

The power supply interface 45 can be electrically connected to an external power supply to provide power to at least one electronic device assembled to the electrical socket 4.

The power converting module 43 is arranged inside the block body 40 and electrically connected to the conductive assembly 41. When the power supply interface 45 is electrically connected to city power, the power converting module 43 converts the received AC power to DC power and outputs DC power through the first or second terminal structures 411*a* or 411*b*.

Additionally, in the embodiment of the instant disclosure, the electrical socket 4 can further include a first switching unit 46*a* and a second switching unit 46*b*. The first switching unit 46*a* is electrically connected between the first terminal structures 411*a* and the power converting module 43. The second switching unit 46*b* is electrically connected between the second terminal structures 411*b* and the power converting module 43. In another embodiment, the electrical socket 4 includes only one switching unit.

The first switching unit 46*a* can control whether the DC power provided by the power converting module 43 is outputted through the first terminal structures 411*a* or not. The second switching unit 46*b* can control whether the DC power provided by the power converting module 43 is outputted through the second terminal structures 411*b* or not. For example, when the first switching unit 43*a* is switched to an open-circuit state between the first terminal structures 411*a* and the power converting module 43, and the second switching unit 43*b* is switched to a closed-circuit state between the second terminal structures 411*b* and the power converting module 43, the DC power can be outputted through the first terminal structures 411*a*, but cannot be outputted through the second terminal structures 411*b*.

Figure 12A:
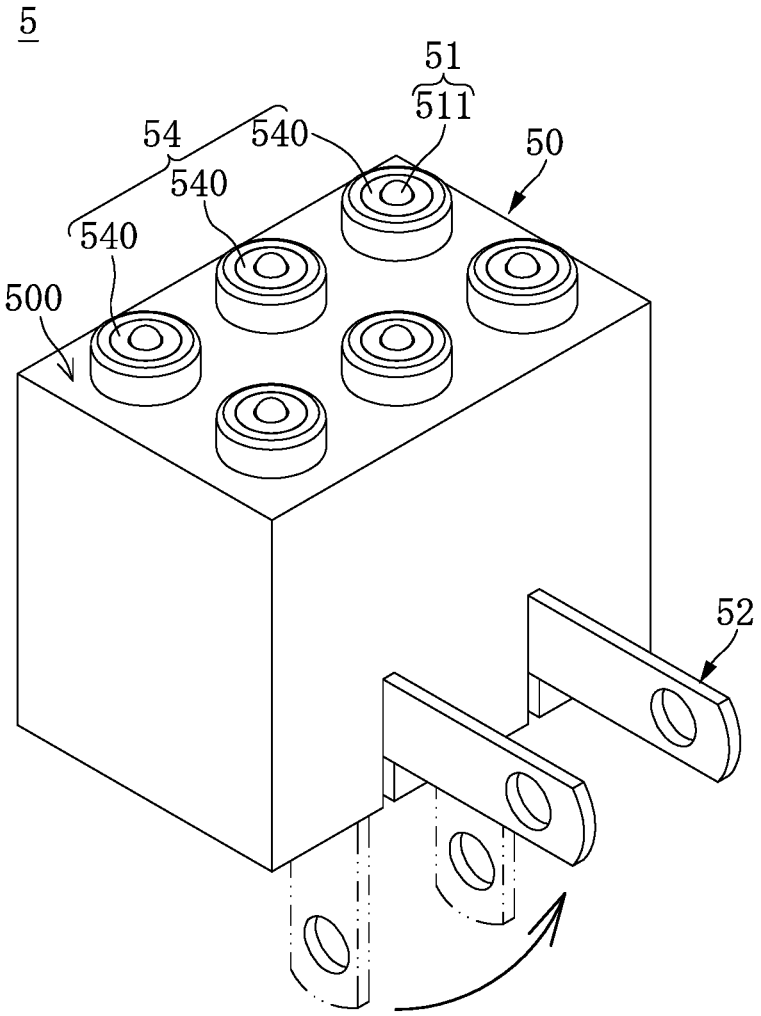
FIG. 12A shows a perspective view of a plug according to another embodiment of the present invention.
Figure 12B:
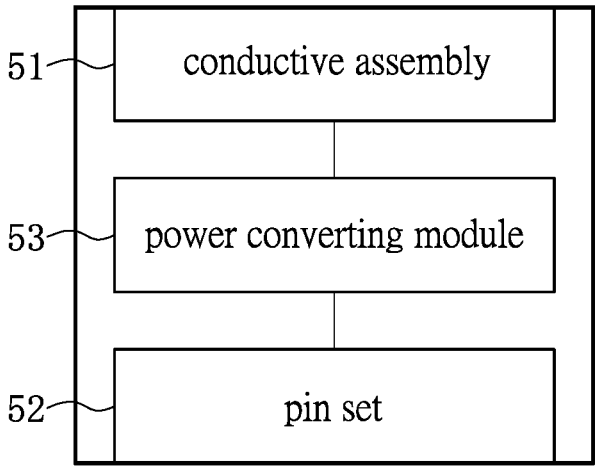
FIG. 12B shows a functional block diagram of a plug according to another embodiment of the present invention.

Subsequently, please refer to FIG. 12A and FIG. 12B. FIG. 12A shows a perspective view of a plug according to another embodiment of the present invention, and FIG. 12B shows a functional block diagram of a plug according to another embodiment of the present invention.

In the embodiment of the instant disclosure, the block body 50 includes a block connecting portion 54 disposed at an assembly side 500 of the block body 50, and a pin set 52 pivotally disposed at another side of the block body 50.

The block connecting portion 54 includes a plurality of the interlocking portions 540 for assembling with one or more conductive devices.

The pin set 52 is pivotally disposed on the block body 50 to electrically connect to the city power. The conductive assembly 51 is arranged inside the block body 50 and electrically connected to the pin set 52. The conductive assembly 51 includes a plurality of first terminal structures 511, which are exposed outside of the block body 50 respectively through the corresponding interlocking portions 540.

Please refer to FIG. 12B. The power converting module 53 is arranged inside the block body 50 and electrically connected between the pin set 52 and the conductive assembly 51. When the pin set 52 is electrically connected to the city power, the power converting module 53 receives AC power through the pin set 52 and converts AC power to DC power. Subsequently, the power converting module 53 outputs DC power through the first terminal structures 511 positioned at the block connecting portion 54.

The user can arbitrarily assemble the conductive device 1, the electrical socket 4 and plug 5 according to practical demands to form different kinds of chargers for different applications.

The descriptions illustrated supra set forth simply the preferred embodiments of the present invention; however, the characteristics of the present invention are by no means restricted thereto. All changes, alterations, or modifications conveniently considered by those skilled in the art are deemed to be encompassed within the scope of the present invention delineated by the following claims.

What is claimed is:

1. A conductive device comprising:

a block body having a fixing portion, wherein the fixing portion has at least two holes formed thereon;

at least two terminal structures arranged inside the block body and immediately adjacent to the holes, respectively;

an equipotential layer electrically connected to the two terminal structures and set to have the same polarity as that of the two terminal structures; and a conductive portion disposed on the block body, wherein a potential difference between the conductive portion and the equipotential layer is set to form a direct-current transmission circuit.

2. The conductive device according to claim 1, further comprising a second terminal structure surrounding at least one of the terminal structures, wherein the second terminal structure is set to have another polarity reverse to the polarity of the terminal structures.

3. The conductive device according to claim 1, further comprising an electrical interface electrically connected to the two terminal structures, wherein the electrical interface and each of the terminal structures form an angle larger than 0 degree and less than 180 degrees.

4. The conductive device according to claim 3, wherein the electrical interface is an USB interface, and the USB interface opens toward a direction not parallel to an extending direction of each terminal structure.

5. The conductive device according to claim 4, wherein the electrical interface is electrically connected to the direct-current transmission circuit in parallel.

6. An conductive device for assembling to another conductive device comprising:

a block body having a fixing portion, wherein the fixing portion has at least two holes formed thereon;

at least two terminal structures arranged inside the block body and immediately adjacent to the holes, respectively;

an equipotential layer electrically connected to the two terminal structures and set to have the same polarity as that of the two terminal structures; and a conductive portion disposed on the block body, wherein the conductive portion is set to have another polarity reverse to the polarity of the terminal structures.

7. The conductive device according to claim 6, wherein when the conductive device is assembled to another conductive device, the fixing portion of the block body of the conductive device is engaged with another fixing portion of another conductive device.

* * * * *